US005461280A

United States Patent [19]

Kane

[11] Patent Number: 5,461,280

[45] Date of Patent: Oct. 24, 1995

[54] FIELD EMISSION DEVICE EMPLOYING PHOTON-ENHANCED ELECTRON EMISSION

[75] Inventor: Robert C. Kane, Woodstock, Ill.

[73] Assignee: Motorola, Schaumburg, Ill.

[21] Appl. No.: 830,977

[22] Filed: Feb. 10, 1992

Related U.S. Application Data

[63] Continuation of Ser. No. 574,995, Aug. 29, 1990, abandoned.

[51] Int. Cl.[6] ..... H01J 40/16

[52] U.S. Cl. ..... 313/531; 313/309; 313/336; 313/351; 257/431

[58] Field of Search ..... 313/309, 310, 313/336, 351, 531, 537; 357/30; 315/150; 257/431

[56] References Cited

U.S. PATENT DOCUMENTS

| | | | |
|---|---|---|---|
| 2,692,948 | 10/1954 | Lion | 315/150 X |
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,814,968 | 6/1974 | Nathanson et al. | 313/309 X |
| 3,894,332 | 7/1975 | Nathanson et al. | 313/409 |
| 3,921,022 | 11/1975 | Levine | 313/309 |
| 3,970,887 | 7/1976 | Smith et al. | 313/309 |
| 3,998,678 | 12/1976 | Fukase et al. | 313/309 |
| 4,008,412 | 2/1977 | Yuito et al. | 313/309 |
| 4,178,531 | 12/1979 | Alig | 313/309 |
| 4,307,507 | 12/1981 | Gray et al. | 313/309 |
| 4,513,308 | 4/1985 | Greene et al. | 313/351 |
| 4,578,614 | 3/1986 | Gray et al. | 313/309 |
| 4,683,399 | 7/1987 | Socloff | 313/537 |
| 4,685,996 | 8/1987 | Busta et al. | 427/253 |
| 4,721,885 | 1/1988 | Brodie | 313/576 |
| 4,818,914 | 4/1989 | Brodie | 315/169.3 |
| 4,827,177 | 5/1989 | Lee et al. | 313/306 |
| 4,874,981 | 10/1989 | Spindt | 313/309 |
| 4,890,035 | 12/1989 | Prein et al. | 313/309 X |
| 4,908,539 | 3/1990 | Meyer | 315/169.3 |
| 4,931,688 | 6/1990 | Tosswill | 315/150 X |

FOREIGN PATENT DOCUMENTS

| | | |
|---|---|---|
| 0172089 | 7/1985 | European Pat. Off. . |
| 2604823 | 10/1986 | France . |
| 2204991 | 11/1988 | United Kingdom . |

OTHER PUBLICATIONS

A Vacuum Field Effect Transistor Using Silicon Field Emitter Arrays, by Gray, 1986, IEDM.

Advanced Technology: flat cold–cathode CRTs, by Ivor Brodie, Information Display Jan. 1989.

Field–Emitter Arrays Applied to Vacuum Flourescent Display, by Spindt et al. Jan., 1989 issue of IEEE Transactions on Electronic Devices.

Field Emission Cathode Array Development For High–Current Density Applications by Spindt et al., dated Aug., 1982 vol. 16 of Applications of Surface Science.

*Primary Examiner*—Sandra L. O'Shea
*Assistant Examiner*—Ashok Patel
*Attorney, Agent, or Firm*—Eugene A. Parsons

[57] ABSTRACT

A cold cathode field emission device employs photon energy and electric field induced electron emission enhancement to provide subthreshold photoelectric emission; and, alternatively, photon-enhanced cold cathode field emission.

4 Claims, 3 Drawing Sheets

FIG. 1
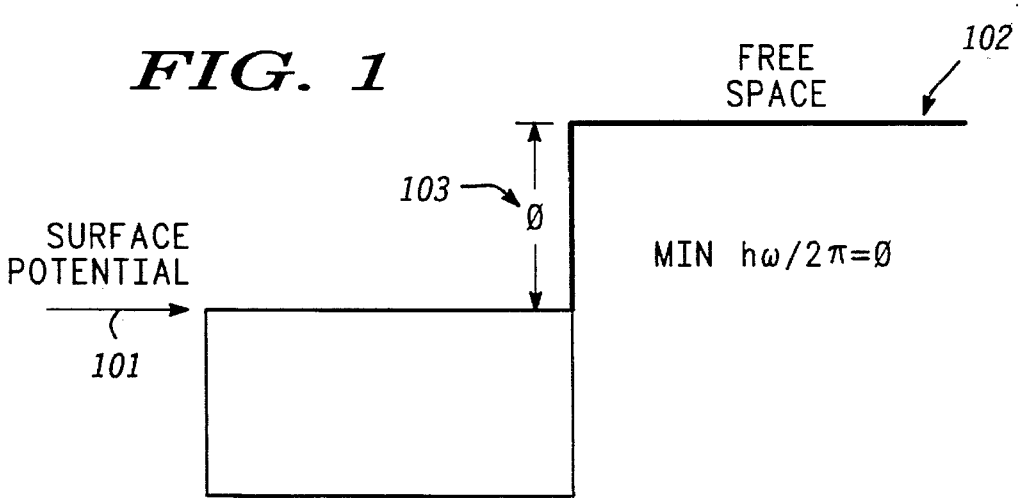
FIG. 2
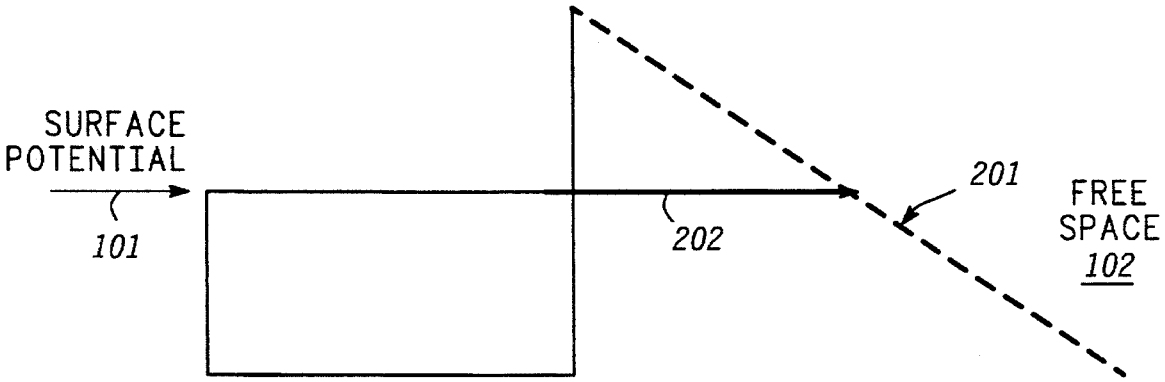
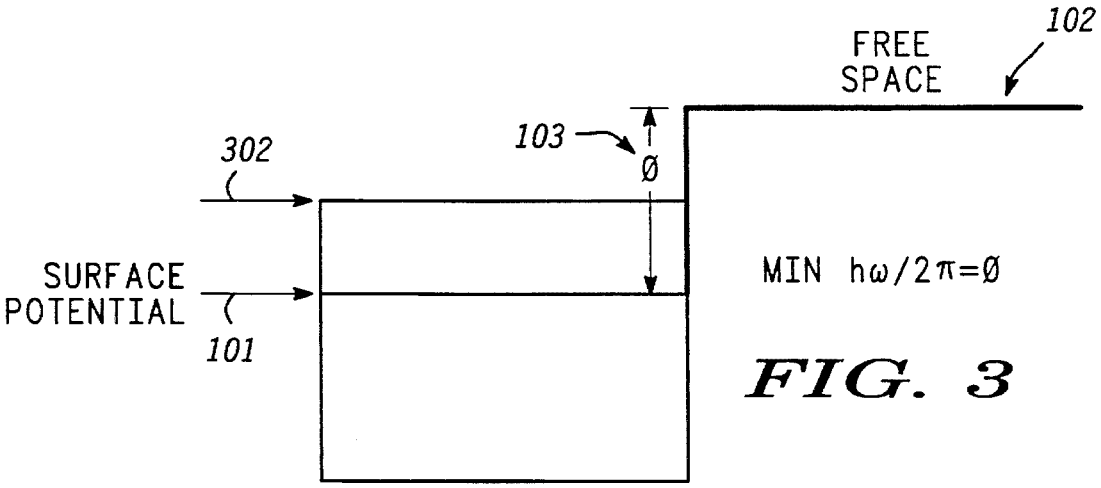
FIG. 3

FIG. 4
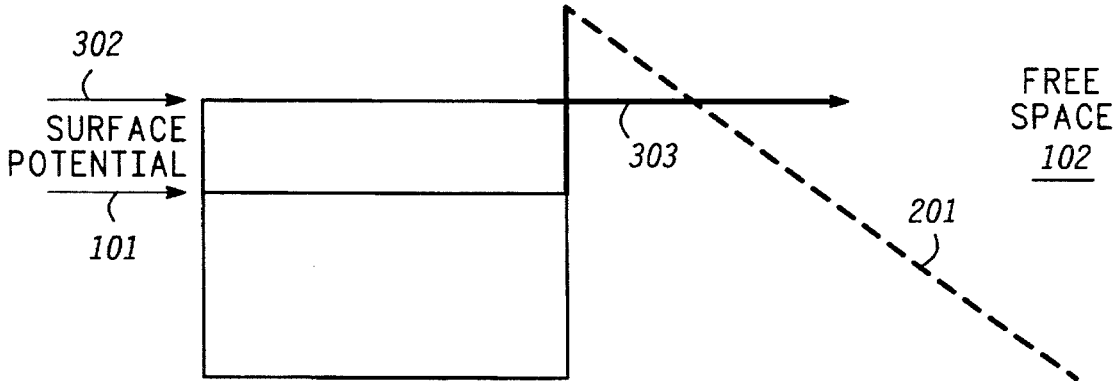
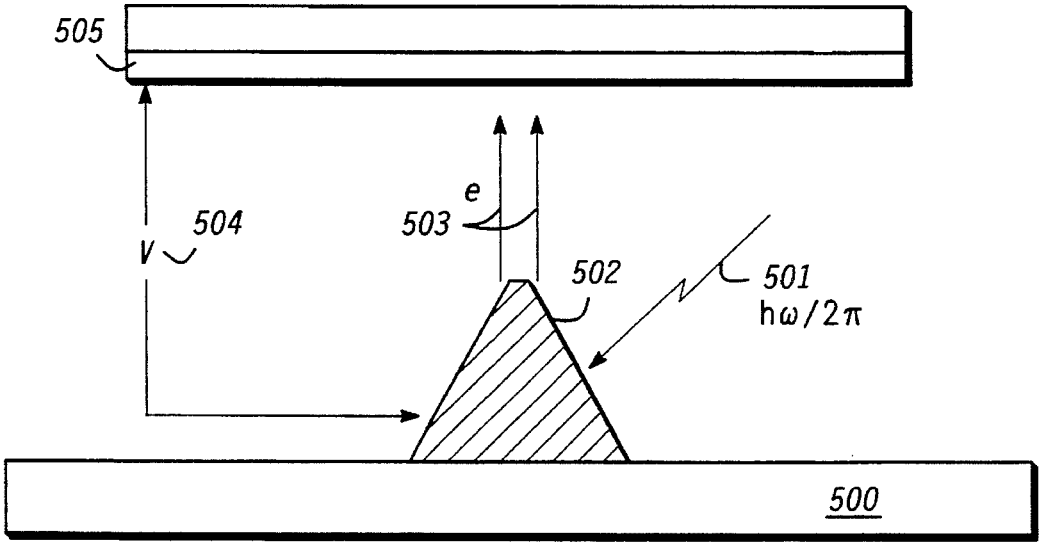
FIG. 5A
FIG. 5B
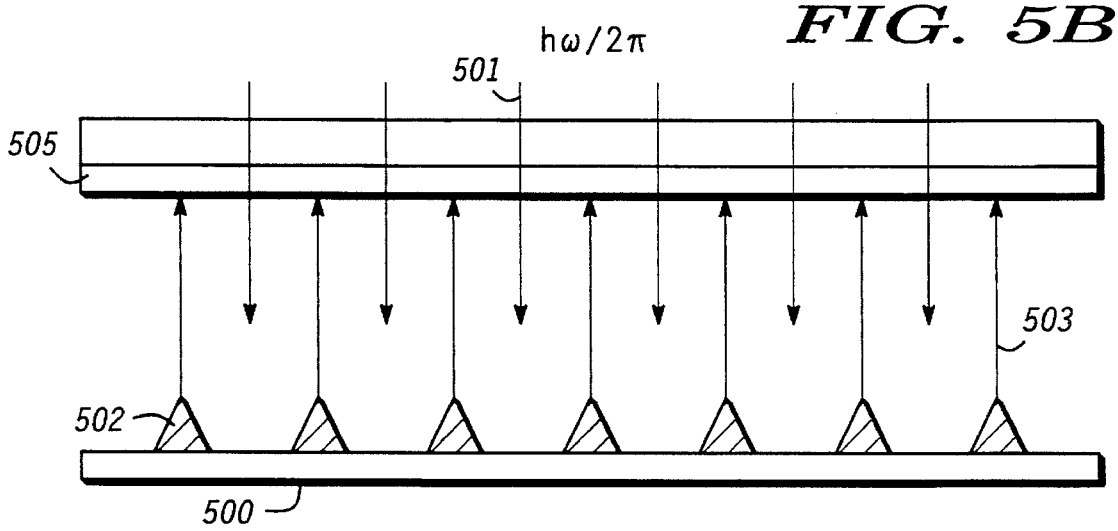

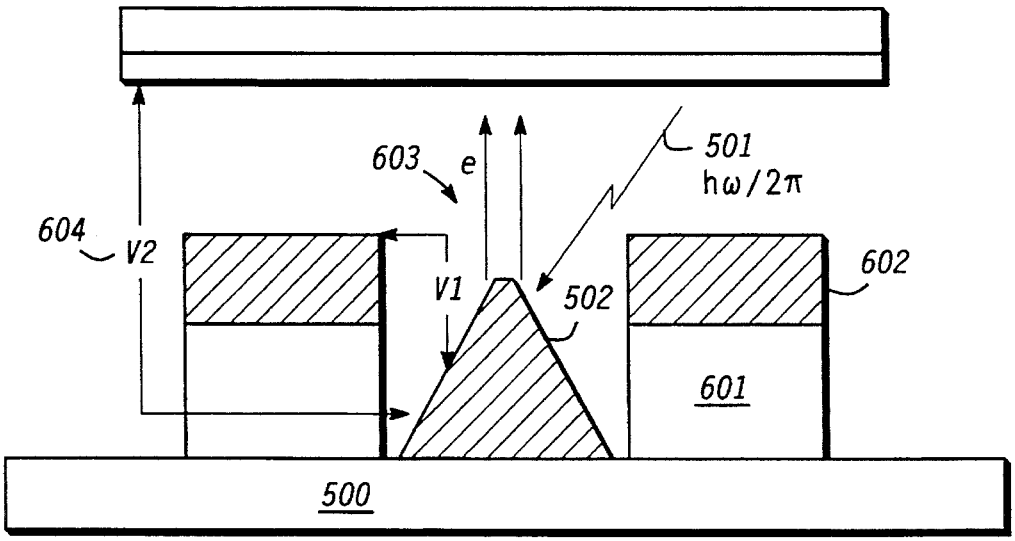
FIG. 6A
FIG. 6B
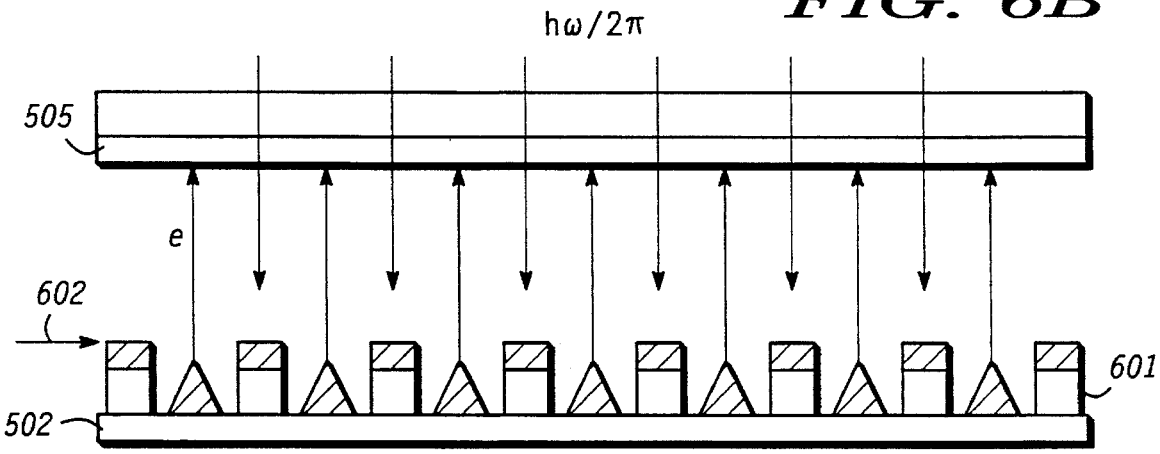

FIELD EMISSION DEVICE EMPLOYING PHOTON-ENHANCED ELECTRON EMISSION

This application is a continuation of prior application Ser. No. 07/574,995, filed Aug. 29, 1990, now abandoned.

TECHNICAL FIELD

This invention relates generally to cold cathode field emission devices.

BACKGROUND OF THE INVENTION

Field emission devices are known in the art. Such devices typically employ electron emitters in concert with applied electric fields to induce electron emission by quantum mechanical tunnelling through the potential barrier at the surface of the emitters. Electron emission is exponentially dependant on the electric field strength at the emission site and emission is increased by reducing the potential barrier width by increasing the applied electric field strength.

Further, non-related photon-induced electron emission is known in the art and is commonly referred to as the photoelectric effect. Photon-induced electron emission from surfaces requires that the exciting photons must possess at least a minimum energy to induce an electron to escape from the surface of the material in which it resides. For materials of interest, this "excitation energy" is between 2–5 electron volts. As such, longer wavelength photons do not possess sufficient energy to induce electron emission. This lower energy limit may be referred to as the photoelectric emission threshold. This limitation precludes the use of infra-red or longer wavelength photon sources to induce electron emission or, conversely, infra-red or longer wavelength photon detectors are not practically employed by methods of the prior art.

Accordingly, there exists a need for devices which provide increased electron emission without the very high electric fields of prior art devices; and there exists a need for devices which provide low-energy photon-induced electron emission not available with the devices of the prior art.

SUMMARY OF THE INVENTION

These needs and others are substantially met through provision of the field emission device (FED) disclosed herein. Pursuant to this invention, an FED is provided wherein electron emission is enhanced as a result of providing a photon source arranged to emit photons that impinge on the emitter of the FED.

In a first embodiment of the invention, an FED is provided with an anode comprised of a substantially optically transparent conductive coating disposed on a substantially optically transparent plate. The associated photon source provides photons that traverse the thickness of the anode, striking the emitter of the FED.

In another embodiment, an optically opaque anode is employed that is selectively patterned and partially disposed on a substantially optically transparent plate. The associated photon source provides photons that traverse the thickness of the optically transparent plate at regions of the optically transparent plate whereon the anode is not disposed, to strike the emitter of the FED.

In still another embodiment, the photon source resides within an encapsulating structure that also contains the FED.

BRIEF DESCRIPTION OF THE DRAWINGS

FIG. 1 depicts the energy levels and potential barrier at and near the surface of a material.

FIG. 2 depicts the energy levels and potential barrier at and near the surface of a material in the presence of an applied electric field.

FIG. 3 depicts the energy levels and potential barrier at and near the surface of a material in the presence of impinging photons.

FIG. 4 depicts the energy levels and potential barrier at and near the surface of a material in the presence of an applied electric field and in the presence of impinging photons.

FIG. 5A depicts a first embodiment of an FED constructed in accordance with the invention.

FIG. 5B depicts a second embodiment of the invention.

FIG. 6A depicts a third embodiment of the invention.

FIG. 6B depicts a fourth embodiment of the invention.

It is noted that FIGS. 5A, 5B, 6A, and 6B are all side-elevational, cross-sectional views.

DETAILED DESCRIPTION OF THE INVENTION

FIGS. 1 through 4 depict the underlying theoretical basis for the operation of an FED constructed in accordance with the invention. In FIG. 1, a surface potential (101) representing the energy level of the highest occupied state of the material of which the emitter of the FED is comprised, is shown. It will be appreciated that electrons residing at or near the surface of the emitter material and occupying an energy state with an energy substantially equal to that of the surface potential (101) will be required to acquire additional energy equal to an amount of energy defined as the work function, Ø (103), of the material. Those electrons acquiring sufficient energy to exceed the potential barrier (102) may escape the surface of the material. Notice that the potential barrier depicted is substantially unlimited in extent which inhibits the possibility of electrons "tunnelling" through the barrier.

Referring now to FIG. 2, a reduced potential barrier (201) is shown which reduced potential barrier (201) is realized through application of an electric field that may be applied by any suitable means such as, for example, a battery or power supply. With a reduced potential barrier (201), electrons (202) with energy levels at or near the surface potential (101) may tunnel through the reduced potential barrier (201) which is now limited in extent and can support electron tunnelling.

FIG. 3 depicts an excited energy level (302) which is distinguished from the surface potential (101) in the following way: In order for electrons in the material of the emitter to attain an energy level represented by the excited energy level (302), the electrons will absorb a photon with energy of at least the difference between the energy level (302) and the energy of the surface potential (101). Therefore, electrons residing in energy states near the energy level of the surface potential (101) may acquire additional energy by absorbing at least a part of a particular quantum of energy to become excited to higher energy states near the excited energy level (302).

FIG. 4 depicts the reduced potential barrier (201) acting in concert with electrons residing in excited energy level states (302) to provide enhanced electron emission accomplished by electrons (303) tunnelling through a narrower region of the reduced potential barrier (201).

Referring now to FIG. 5A, there is shown a first embodiment of the invention. As shown, the FED employs an emitter (502) disposed on a surface of a substrate (500). The anode (505) collects electrons (503) emitted from the emitter (502). A voltage (504) which serves as an electric field source is applied between the anode (505) and the emitter (502) of the FED to achieve the reduced potential barrier (201) (see discussion for FIGS. 2 and 4, above). The voltage (504), operably coupled between the anode (505) and the emitter (502), also serves as a current source of electrons.

As further shown, the FED resides in an environment wherein photons (501) impinge on the surface of the emitter (502). As electrons residing at or near the surface of the emitter (502) absorb energy from impinging photons (501), they shift to an excited energy level (302) (see discussion for FIGS. 3 and 4, above). These higher energy state electrons exhibit an increased probability of tunnelling through the reduced potential barrier (201), therefore resulting in an increased quantity of emitted electrons (303).

It will be appreciated that the embodiment depicted in FIG. 5A provides for enhanced electron emission through utilization of photon absorption; and further, by employing potential barrier reduction, provides for initiation of photoelectric emission, at photon energies below the photoelectric emission threshold.

The anode (505) employed in the FED depicted in FIG. 5A may be comprised of a substantially transparent conductive coating such as, for example, Indium-Tin-Oxide, which is disposed on a surface of a generally optically transparent plate. A further possible configuration of the anode (505) of FIG. 5A is a selectively patterned conductive material disposed on part of a surface of a generally optically transparent plate.

A second embodiment of the invention is shown in FIG. 5B. There is shown a plurality of FED emitters (502) disposed on a substrate (500). Again, enhanced electron emission is realized since photons (501) traversing the thickness of the anode (505) impart energy to electrons residing in the emitters (502).

A third embodiment of the invention is shown in FIG. 6A. There is shown a gate extraction electrode (602) disposed on an insulator layer (601) which, in turn, is disposed on a substrate (500). As shown, the gate extraction electrode (602) is further disposed in a generally symmetric and peripheral fashion about the emitter (502). As above, a first voltage (603) applied between the gate extraction electrode (602) and the emitter (502) sets up an electric field, thereby causing a reduced potential barrier (201). As above, emission of electrons (503) is enhanced as photons (501) traversing the thickness of the anode (505) impart energy to electrons residing at or near the surface of the emitter (502). As shown, a second voltage (604), applied between the anode (505) and the emitter (502), causes the anode (505) to collect emitted electrons (503).

Referring still to FIG. 6A, it will be appreciated that, due to the potential barrier lowering resulting from application of the voltage (603) between the gate extraction electrode (602) and the emitter (502), photoelectric electron emission also may be initiated by photons (501) of energy content below the photoelectric emission threshold impinging on, and imparting at least sufficient energy to, electrons residing at or near the surface of the emitter (502) such that at least some electrons residing at or near the surface of the emitter (502) are shifted to an excited energy level (302) and correspondingly tunnel through the reduced potential barrier (201) at an increased rate to escape the surface of the emitter (502).

A fourth embodiment of the invention is show in FIG. 6B. There is shown a plurality of emitters (502) disposed as in FIG. 6A, discussed above. As shown in FIG. 6B, the gate extraction electrode (602), which is comprised of conductive or semiconductive material, is disposed on the insulator layer (601). Also as shown, each gate extraction electrode (602) is further disposed in a generally symmetric and peripheral fashion about the corresponding emitter (502).

It will be apparent to one skilled in the art that additional embodiments of the invention may employ a photon source arranged so that photons impinge on the surface of the FED emitters without passing through an anode. Such embodiments may provide an optically opaque conductive or semiconductive material without the need to provide regions through which photons may pass. Such embodiments may be realized, for example, as encapsulated structures wherein an FED and a photon source are disposed. It will be further obvious to those skilled in the art that the embodiments described herein may be encapsulated or enclosed within various structures to provide discrete and integrated electronic devices which may further utilize the features of the invention.

What is claimed is:

1. A field emission device employing photon-enhanced electron field emission comprising:

an emitter, formed of material having a predetermined surface potential barrier such that electrons require a work function of Ø to escape the emitter, the emitter having electrons with an energy level below the work function Ø of the emitter;

a gate extraction electrode spaced from the emitter and constructed to have connected between the emitter and the gate extraction electrode a bias voltage which reduces the extent of the surface potential barrier of the emitter sufficiently to allow quantum mechanical tunneling of the electrons through the reduced extent of the surface potential barrier in response to photons impinging on the emitter and raising the energy level of the electrons; and an anode spaced from the emitter and the gate extraction electrode and positioned to receive electrons emitted from the emitter, the anode being substantially optically transparent for facilitating traversing of photons therethrough and subsequent impinging of the photons on the emitter to enhance electron field emission therefrom.

2. A field emission device employing photon-enhanced electron field emission as claimed in claim 1 wherein the emitter is a relatively sharp projection and the gate extraction electrode is disposed generally symmetrically and peripherally about the emitter.

3. A method of increasing electron field emission from an emitter of a field emission device comprising the steps of:

providing the field emission device with the emitter formed of material having a predetermined surface potential barrier such that electrons require a work function of Ø to escape the emitter, the emitter having electrons with an energy level below the work function Ø of the emitter, a gate extraction electrode spaced from the emitter and an anode spaced from the emitter and the gate extraction electrode which is positioned to receive electrons emitted from the emitter;

reducing the extent of the predetermined surface potential barrier of the emitter sufficiently to allow quantum mechanical tunneling of the electrons through the reduced extent of the surface potential barrier in response to photons impinging on the emitter and raising the energy level of the electrons by applying a bias voltage between the gate extraction electrode and the emitter;

impinging photons on the emitter to raise the energy level of the electrons of the emitter and enhance electron field emission; and applying an electric field between the emitter and the anode to collect electrons emitted by the emitter.

4. A method of increasing electron field emission from an emitter of a field emission device as claimed in claim 3 including the step of providing the anode which is substantially optically transparent for facilitating the traversing of photons therethrough and the subsequent impinging of the photons on the emitter.

* * * * *